US008325099B2

(12) United States Patent
Cavener et al.

(10) Patent No.: US 8,325,099 B2
(45) Date of Patent: Dec. 4, 2012

(54) METHODS AND APPARATUS FOR COINCIDENT PHASE CENTER BROADBAND RADIATOR

(75) Inventors: Ronni J. Cavener, Haverhill, MA (US); Robert V. Cummings, Anacortes, WA (US)

(73) Assignee: Raytheon Company, Waltham, MA (US)

( * ) Notice: Subject to any disclaimer, the term of this patent is extended or adjusted under 35 U.S.C. 154(b) by 517 days.

(21) Appl. No.: 12/644,288

(22) Filed: Dec. 22, 2009

(65) Prior Publication Data

US 2011/0148725 A1 Jun. 23, 2011

(51) Int. Cl.
*H01Q 13/10* (2006.01)

(52) U.S. Cl. ..... 343/770; 343/767

(58) Field of Classification Search ..... 343/767, 343/770, 700 MS

See application file for complete search history.

(56) References Cited

U.S. PATENT DOCUMENTS

| | | | |
|---|---|---|---|
| 3,836,976 | A | 9/1974 | Monser et al. |
| 4,001,834 | A | 1/1977 | Smith |
| 4,500,887 | A | 2/1985 | Nester |
| 4,973,925 | A | 11/1990 | Nusair et al. |
| 5,070,340 | A | 12/1991 | Diaz |
| 5,185,611 | A | 2/1993 | Bitter, Jr. |
| 5,208,602 | A | 5/1993 | Monser et al. |
| 5,248,987 | A | 9/1993 | Lee |
| 5,268,701 | A | 12/1993 | Smith |
| 5,428,364 | A | 6/1995 | Lee et al. |
| 5,519,408 | A | 5/1996 | Schnetzer |
| 5,557,291 | A | 9/1996 | Chu et al. |
| 5,786,792 | A | 7/1998 | Bellus et al. |
| 5,949,382 | A | 9/1999 | Quan |
| 5,977,911 | A | 11/1999 | Green et al. |
| 6,208,308 | B1 | 3/2001 | Lemons |
| 6,271,799 | B1 | 8/2001 | Rief et al. |
| 6,292,153 | B1 | 9/2001 | Aiello et al. |
| 6,300,906 | B1 | 10/2001 | Rawnick et al. |
| 6,518,931 | B1 | 2/2003 | Sievenpiper |
| 6,552,691 | B2 | 4/2003 | Mohuchy et al. |
| 6,771,226 | B1 | 8/2004 | Dujmovic |

(Continued)

FOREIGN PATENT DOCUMENTS

| | | |
|---|---|---|
| DE | 3215323 | 7/1983 |

(Continued)

OTHER PUBLICATIONS

Notification of Transmittal of the International Search Report and the Written Opinion of the International Searching Authority, or the Declaration; PCT/US2010/057179, dated Sep. 27, 2011, 7 pages.

(Continued)

*Primary Examiner* — Tan Ho

(74) *Attorney, Agent, or Firm* — Daly, Crowley, Mofford & Durkee, LLP

(57) ABSTRACT

Methods and apparatus for a coincident phase center dual polarized slotline radiator. In one embodiment, a radiator includes, for each of two polarizations in a unit cell: first and second fins to provide an air transition for a signal, the radiator including a throat region between the first and second fins, a microstrip path transitioning to a slotline feed, a slotline split forming a part of the slotline feed to provide signal power division and 180 degree phase shift for rejoinder in the throat of the radiator to launch the signal into free space. In another embodiment, a four port radiator is provided.

13 Claims, 11 Drawing Sheets

U.S. PATENT DOCUMENTS

| | | | | |
|---|---|---|---|---|
| 7,167,136 | B2 * | 1/2007 | Thudor et al. | 343/770 |
| 7,180,457 | B2 | 2/2007 | Trott et al. | |
| 7,444,736 | B1 | 11/2008 | Warning | |
| 7,505,001 | B2 | 3/2009 | Deavours et al. | |
| 7,642,980 | B2 * | 1/2010 | Louzir et al. | 343/767 |
| 7,683,846 | B2 * | 3/2010 | Yoon et al. | 343/767 |
| 2002/0180655 | A1 | 12/2002 | Mohuchy et al. | |
| 2009/0102577 | A1 | 4/2009 | U-Yen et al. | |
| 2009/0102578 | A1 | 4/2009 | U-Yen et al. | |

FOREIGN PATENT DOCUMENTS

| | | |
|---|---|---|
| EP | 0634808 | 1/1995 |
| EP | 1006609 | 6/2000 |

OTHER PUBLICATIONS

Written Opinion of the International Searching Authority; PCT/US2010/057179, dated Sep. 27, 2011, 9 pages.

Claudio M. Montel, Lu Fan, Kai Chang, Active-Notch Antennas Stabilized with a Slotline-Ring Resonator for Wireless Applications, IEEE Transactions of Antennas and Propagation, vol. 46, No. 6, Jun. 1998, pp. 945-946.

U.S. Appl. No. 10/989,231, filed Nov. 10, 2004, 295 pages.

Kongpop U-Yen, Edward J. Wollack, Stephen Horst, Terence Doiron, John Papapolymerou, Joy Laskar, "Slotline Stepped Circular Rings for Low-Loss Microstrip-to-Slotline Transitions", IEEE Microwave and Wireless Components Letters, vol. 17, No. 2, Feb. 2007, pp. 1-3.

Schaubert et al.; "Wideband Vivaldi Arrays for Large Aperture Antennas", 1999, pp. 49-57, Perspectives on Radio Astronomy—Technologies for Large Antenna Arrays, Netherlands Foundation for Research in Astronomy—1999.

Trott et al.; "Wideband Phased Array Radiator", pp. 1-4, 2003 IEEE Phased Array Conference Proceedings held in Boston, MA, Oct. 14-17, 2003.

Herscovici, "Extremely Wide-Band Antennas for Wireless Communication", presented at 1998 Wireless Symposium; Cushcraft Corp, 2 pages.

Smolders et al.; "Wide-Band Antenna Element with Integrated Balun", presented at the IEE APS Int. Symposium Atlanta USA 1998, 4 pages.

York; "Broadband Microwave Power Combiners using Active Arrays in an Oversized Coasial Waveguide", Final Report 1997-98 for Micro project 97-217; Sponsored by Hughes Space and Communications, El Segundo, CA, USA, 3 pages.

DeLuca; "A Broadband Dual Polarized Slotline Feed", Engineering Project ECE 688, University of Massachusetts/Raytheon, Dec. 16, 2002, pp. 1-37.

Notification of Transmittal of the International Search Report and the Written Opinion of the International Searching Authority, or the Declaration; PCT/US2004/016336 dated Oct. 5, 2004, 5 pages.

Written Opinion of the International Searching Authority; PCT/US2004/016336 dated Oct. 5, 2004, 8 pages.

U.S. Appl. No. 10/617,620, filed Jul. 11, 2003, file through Jul. 23, 2010, 377 pages.

PCT International Preliminary Report on Patentability of the ISA dated Jul. 5, 2012; for PCT Pat. App. No. PCT/US2010/057179; 9 pages.

* cited by examiner

METHODS AND APPARATUS FOR COINCIDENT PHASE CENTER BROADBAND RADIATOR

STATEMENTS REGARDING FEDERALLY SPONSORED RESEARCH

This invention was made with government support under Contract No. N-00014-04-C-0588 awarded by the Department of the Navy. The government has certain rights in the invention.

BACKGROUND

In communication systems, radar, direction finding and other broadband multifunction systems having limited aperture space, it is often desirable to efficiently couple a radio frequency transmitter and receiver to an antenna having an array of broadband dual polarized radiator elements.

Conventional broadband phased array radiators generally suffer from significant polarization degradation at large scan angles in the diagonal scan planes. This limitation can force a polarization weighting network to heavily weight a single polarization. Such weighting results in the transmit array having poor antenna radiation efficiency because the unweighted polarization signal must supply most of the antenna Effective Isotropic Radiated Power (EIRP) of the transmitted signal.

Conventional broadband phased array radiators generally use a simple, but asymmetrical feed. Since a conventional broadband radiator is capable of supporting a relatively large set of higher-order propagation modes, the feed region acts as the launcher for these high-order propagation mode signals. The feed is essentially the mode selector or filter. A physical asymmetry in the feed region produces asymmetry in the orientation of launched fields and higher-order modes are excited. Those modes then propagate to the aperture. The higher-order modes cause problems in the radiator performance. The field at the aperture is the superposition of multiple excited modes, and since higher-order modes propagate at differing phase velocities, sharp deviations from uniform magnitude and phase in the unit cell fields result. The fundamental mode aperture excitation is relatively simple, usually resulting from the $TE_{01}$ mode, with a cosine distribution in the E-plane and uniform field in the H-plane. Significant deviations from the fundamental mode result from the excited higher-order modes, and the higher order modes are responsible for a total mismatch (referred to as a scan blindness or resonance) at certain scan angles and frequencies.

Another effect produced by the presence of higher-order mode propagation in asymmetrically-fed wideband radiators is cross-polarization. Particularly in the diagonal planes, many higher-order modes include an asymmetry that excites the cross-polarized field, which is corrected with an unbalanced weighting in the antenna polarization weighting network resulting in low array transmit power efficiency.

Conventional broadband radiators not only employ an asymmetric feed, but also have offset phase centers which, in dual polarization operation, produce phase errors that cannot be corrected with phase and amplitude compensation over wide instantaneous bandwidths. An array with coincident phase centers eliminates these errors since the phase center for both polarizations is in the center of the unit cell.

U.S. Pat. No. 7,180,457, which is incorporated herein by reference, discloses a prior art electrically short crossed notch (ESCN) radiator in FIG. 1A and a prior art feed circuit in FIG. 1B. The ESCN uses balanced symmetry throughout the unit cell in order to provide superior cross polarization isolation over a 3:1 operating band and a 60 degree conical field of view. A microstrip distribution circuit is backed by a cavity designed to cut off higher order modes capable of launching cross-polarized fields.

FIG. 1A shows the '457 prior art coincident phase center broadband antenna 10 having a wide frequency band, e.g., 3-to-1, with good polarization purity. The antenna 10 includes a cavity plate 12 and an array of notch antenna elements generally denoted 14. Taking a unit cell 14*a* as representative of each of the unit cells 14, unit cell 14*a* is provided from four fin-shaped members 16*a*, 16*b*, 18*a*, 18*b*. Fin-shaped members 16*a*, 16*b*, 18*a*, 18*b* are disposed on a feed structure. By disposing the members 16*a*, 16*b* orthogonal to members 18*a*, 18*b*, each unit cell is responsive to orthogonally directed electric field polarizations. That is, by disposing one set of members (e.g. members 16*a*, 16*b*) in one polarization direction and disposing a second set of members (e.g. members 18*a*, 18*b*) in the orthogonal polarization direction, an antenna that is responsive to signals having any polarization is provided.

In one embodiment, to facilitate the manufacturing process, at least some of the fin-shaped members 16*a* and 16*b* can be manufactured as "back-to-back" fin-shaped members as illustrated by member 22. Likewise, the fin-shaped members 18*a* and 18*b* can also be manufactured as "back-to-back" fin shaped members as illustrated by member 23. Thus, as can be seen in unit cells 14*k* and 14*k'*, each half of a back-to-back fin-shaped member forms a portion of two different notch elements.

FIG. 1B shows an exploded view of the prior art '457 ESCN raised pyramidal feed. A radiator feed circuit 50 is coupled to a bracket 52 with a bond film 54 therebetween. Balun assemblies 58 in the assembly contribute significant cost and part count to manufacture. Output lines 60, grounding gasket 62, and conductive bond films 64 complete the assembly. The microstrip circuit is a molded piece with four legs with opposing legs fed 180 degrees out of phase so that the signals cancel in the throat region of the radiator, launching an odd-mode field between the tapered fins.

While known ESCN designs may provide excellent cross polarization and matching throughout the scan volume, the balun and feed structure have a relatively high part count and a complex and costly assembly process.

SUMMARY OF THE INVENTION

The present invention provides methods and apparatus for an electrically short crossed notch radiator having a slotline feed and printed circuit board structure with a reduced parts count and cost as compared with known radiators. With this arrangement, an electrically short crossed notch radiator is provided that is practical to manufacture. While exemplary embodiments of the invention are shown and described as having particular structures, configurations, and applications, it is understood that the invention is applicable to antenna systems in general in which notch radiators are desirable.

In one aspect of the invention, a radiator comprises, for each of two polarizations in a unit cell: first and second fins to provide an air transition for a signal, the radiator including a throat region between the first and second fins, a signal path transitioning to a slotline feed, and a slotline split forming a part of the slotline feed to provide signal power division and 180 degree phase shift for rejoinder in the throat of the radiator to launch the signal into free space.

The radiator can further include one or more of the following features: two ports, the slotline feed includes a portion having a forty-five degree slant terminating in the phase center, a virtual short for the transition to the slotline, a slot for fitting together first and second circuit boards to provide a coincident phase center, the slotline feed widens in the throat of the radiator, the signal path includes microstrip transitioning to the slotline feed.

In another aspect of the invention, a radiator comprises, for each of two polarizations in a unit cell, first and second fins to provide an air transition for a signal, a throat region between the first and second fins, a first signal path transitioning to a first slotline feed, a second signal path transitioning to a second slotline feed, and a slotline rejoinder for rejoining signals of the first and second slotline feeds in the throat of the radiator to launch signal into free space.

The radiator can further include one or more of the following features: a virtual short for each of the first and second signal paths for the transitions to the respective first and second slotline feeds, a slot for fitting together first and second circuit boards to provide a coincident phase center, the first and second slotline feeds widen into the throat of the radiator, the first signal path includes microstrip transitioning to the first slotline feed, and the slotline rejoinder includes a generally semi-circular region defining a portion of the first and second slotline feeds.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Before describing the antenna system of the present invention, it should be noted that reference is sometimes made herein to an array antenna having a particular array shape (e.g. a planar array). One of ordinary skill in the art will appreciate of course that the techniques described herein are applicable to various sizes and shapes of array antennas. It should thus be noted that, although the description provided below describes the inventive concepts in the context of a rectangular array antenna, those of ordinary skill in the art will appreciate that the concepts equally apply to other sizes and shapes of array antennas including, but not limited to, arbitrary shaped planar array antennas as well as cylindrical, conical, spherical and arbitrary shaped conformal array antennas.

Reference is also sometimes made herein to the array antenna including a radiating element of a particular size and shape. For example, one type of radiating element is a so-called notch element having a tapered shape and a size compatible with operation over a particular frequency range (e.g. 2-18 GHz). Those of ordinary skill in the art will recognize, of course, that other shapes of antenna elements may also be used and that the size of one or more radiating elements may be selected for operation over any frequency range in the RF frequency range (e.g. any frequency in the range from above 1 GHz to below 50 GHz).

Also, reference is sometimes made herein to generation of an antenna beam having a particular shape or beamwidth. Those of ordinary skill in the art will appreciate, of course, that antenna beams having other shapes and widths may also be used and may be provided using known techniques, such as by inclusion of amplitude and phase adjustment circuits into appropriate locations in an antenna feed circuit.

Exemplary embodiments of the invention provide a slotline electrically short crossed notch radiator having a coincident phase center radiator in an assembly that is cost effective and practical to manufacture. By replacing a conventional balun with a slotline split, significant advantages are provided in manufacture and assembly, as described in detail below.

Figure 2:
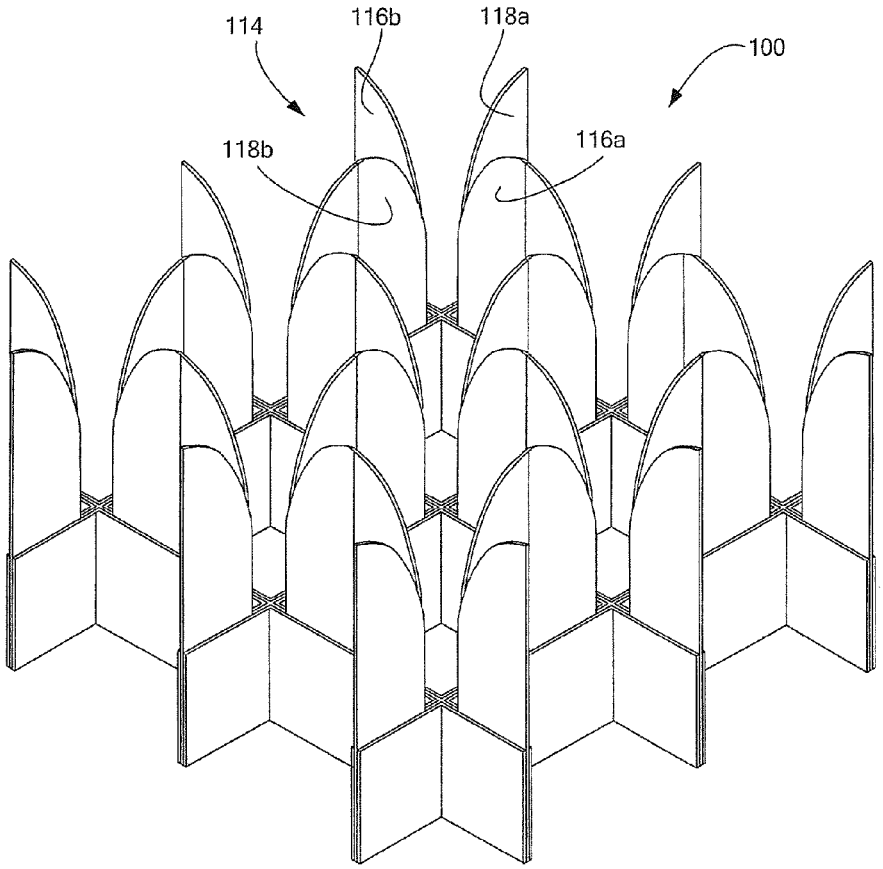
FIG. 2 is an isometric view of an array of coincident phase centered notch radiators provided from a plurality of fin elements.

FIG. 2 shows a three-by-three section 100 of an array of dual polarized radiators with coincident phase centers in accordance with exemplary embodiments of the invention. In each unit cell 114, a pair of tapered fins 116*a*, 116*b* forms a flared notch for one polarization and crosses with an orthogonal pair 118*a*, 118*b* that supports the orthogonal polarization.

Figure 2A:
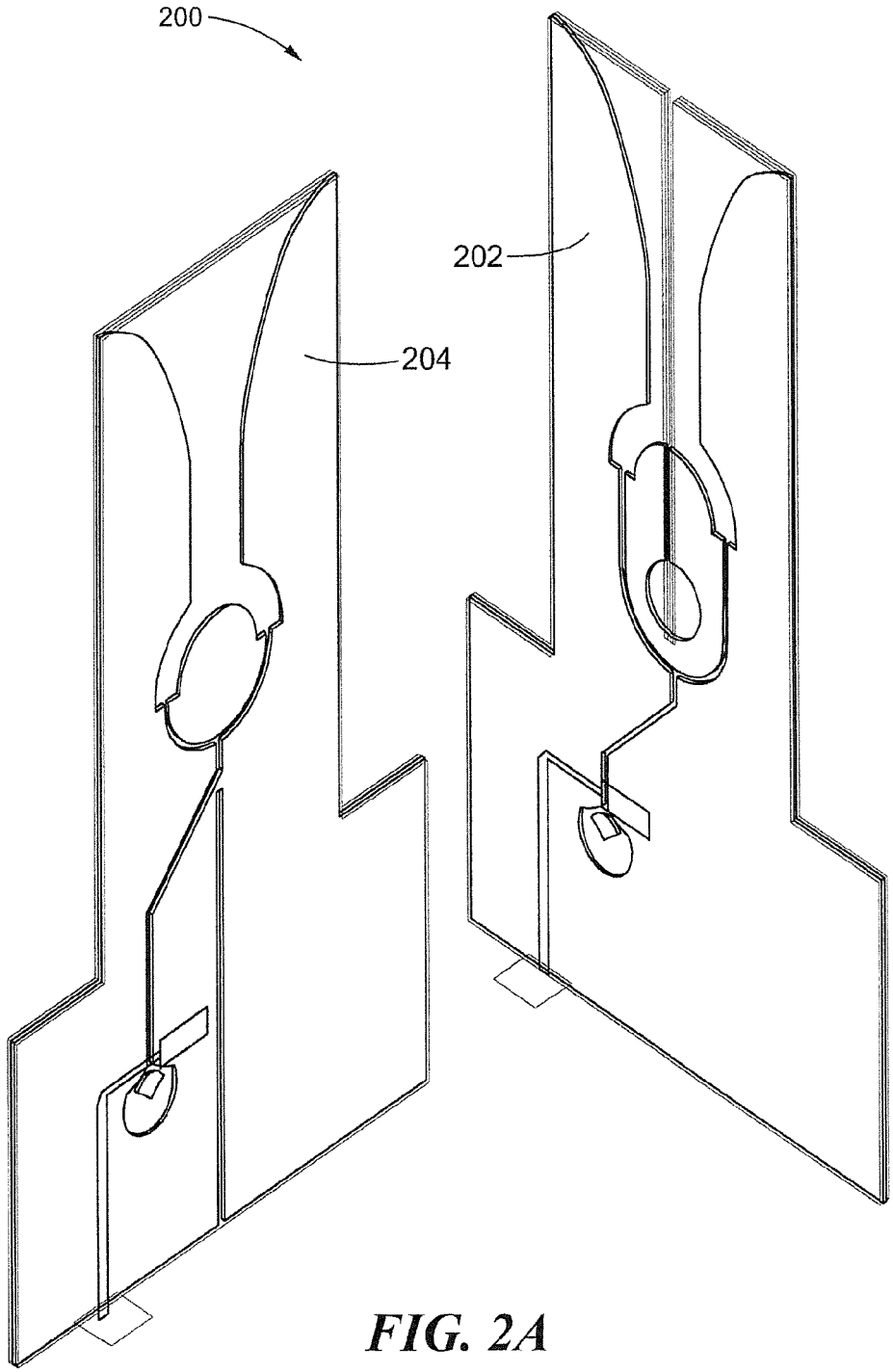
FIG. 2A is a view of a radiator in accordance with the present invention fed by one port per polarization.
Figure 2B:
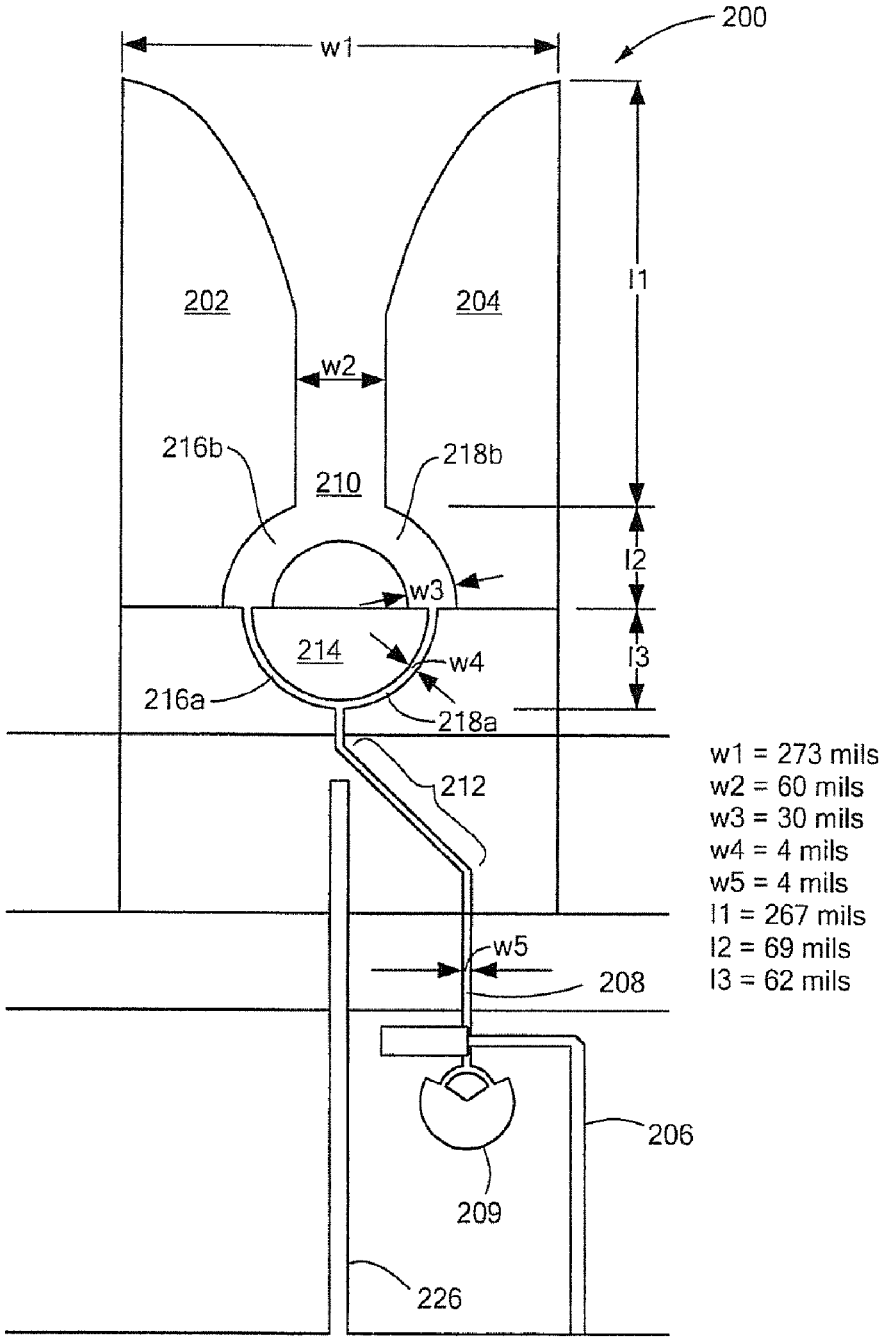
FIG. 2B is a schematic representation of a radiator with a single polarization fed with one port in accordance with exemplary embodiments of the present invention.

FIG. 2A shows a two port slotline electrically short crossed notch (ESCN) radiator 200 having a first polarization orthogonal to a second polarization. It is understood that the structures for the first and second polarizations are shown separated to better show the features of each. FIG. 2B shows a side view of a single polarization of the two port design 200 of FIG. 2A with exemplary dimensions.

Figure 2C:
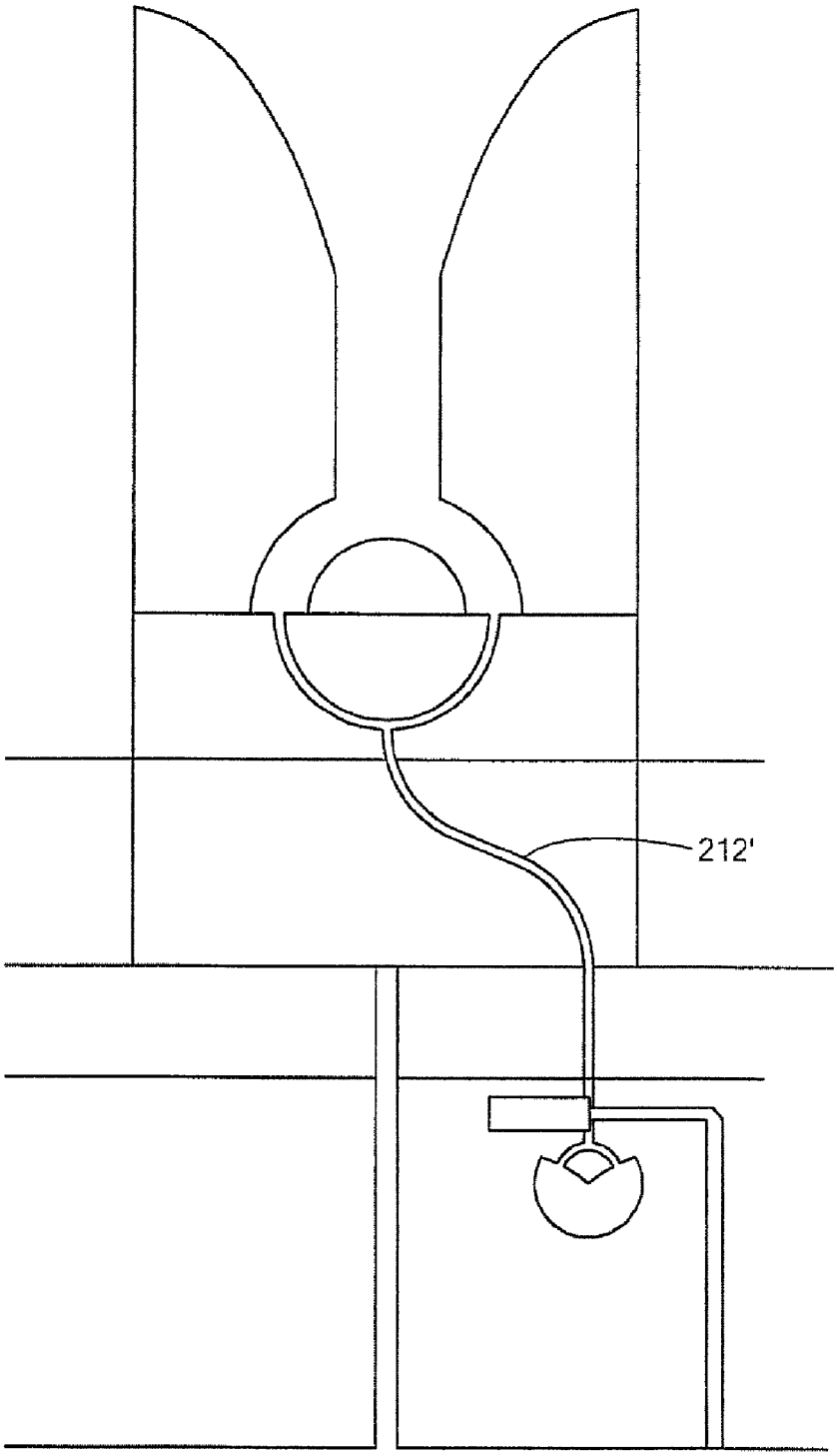
FIG. 2C is a schematic representation of an alternative embodiment of the radiator of FIG. 2B.

In general, the radiator includes a microstrip to slotline transition, a path to the center line of the unit cell (shown here as a 45 degree slant), a slotline split to provide power division and a 180 degree phase shift between the two slotlines, and the odd-mode feed to the radiator throat. It is understood that any suitable slant angle can be used to meet the needs of a particular angle. In other embodiments, the slotline 212' to the center line of the unit cell is not linear, i.e., the path can be at least partially arcuate, as shown in FIG. 2C.

The radiator 200 includes a microstrip 206 to slotline 208 transition including a virtual short 209 and slotline match to the fins 202, 204 in a throat region 210 of the radiator. In an exemplary embodiment, a forty-five degree slant 212 is provided as part of the slotline path to provide coincident phase centers.

A slotline split 214 provides power division and phase shift. As can be seen, in the illustrated two-port slotline embodiment the slotline feed transitions into a 180 degree split into slotline paths 216*a*, 218*a* of equal length that widen 216*b*, 218*b* in the throat of the radiator. This arrangement eliminates the need for a conventional balun, which greatly reduces manufacture cost. In an exemplary embodiment, the slotline split provides equal power division and 0/180 degree phase shift.

A slot 226 enables first and second boards to fit together to provide coincident phase centers for a dual polarization embodiment. In a dual polarized radiator embodiment, the radiator is fed by two microstrip to slotline transitions.

While a microstrip signal path is shown transitioning to slotline, it is understood that any suitable structure, such as stripline, can be used instead of microstrip.

Figure 1A:
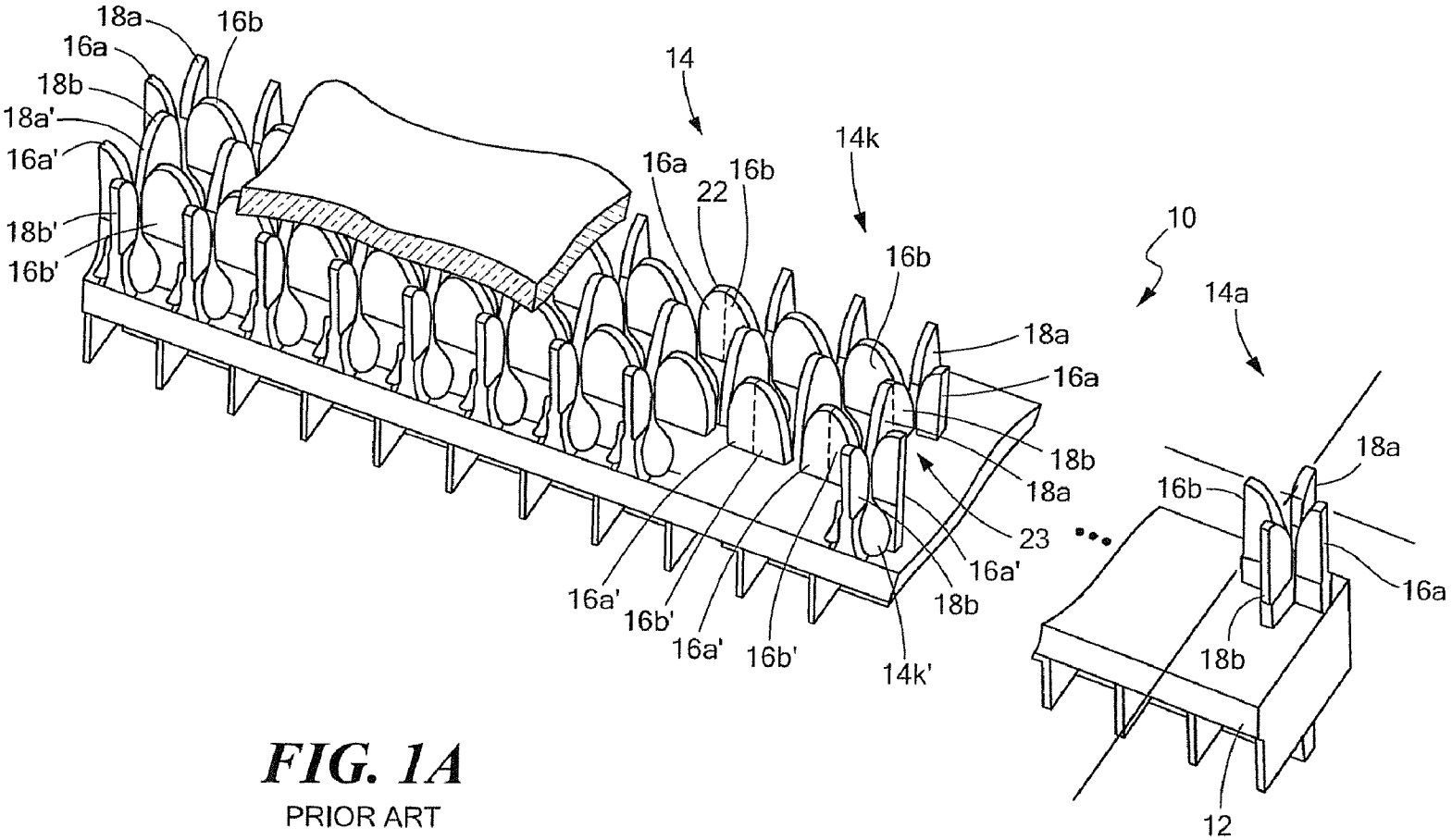
FIG. 1A PRIOR ART
FIG. 1A is a schematic representation of a prior art dual polarized coincident phase centered radiator.
Figure 1B:
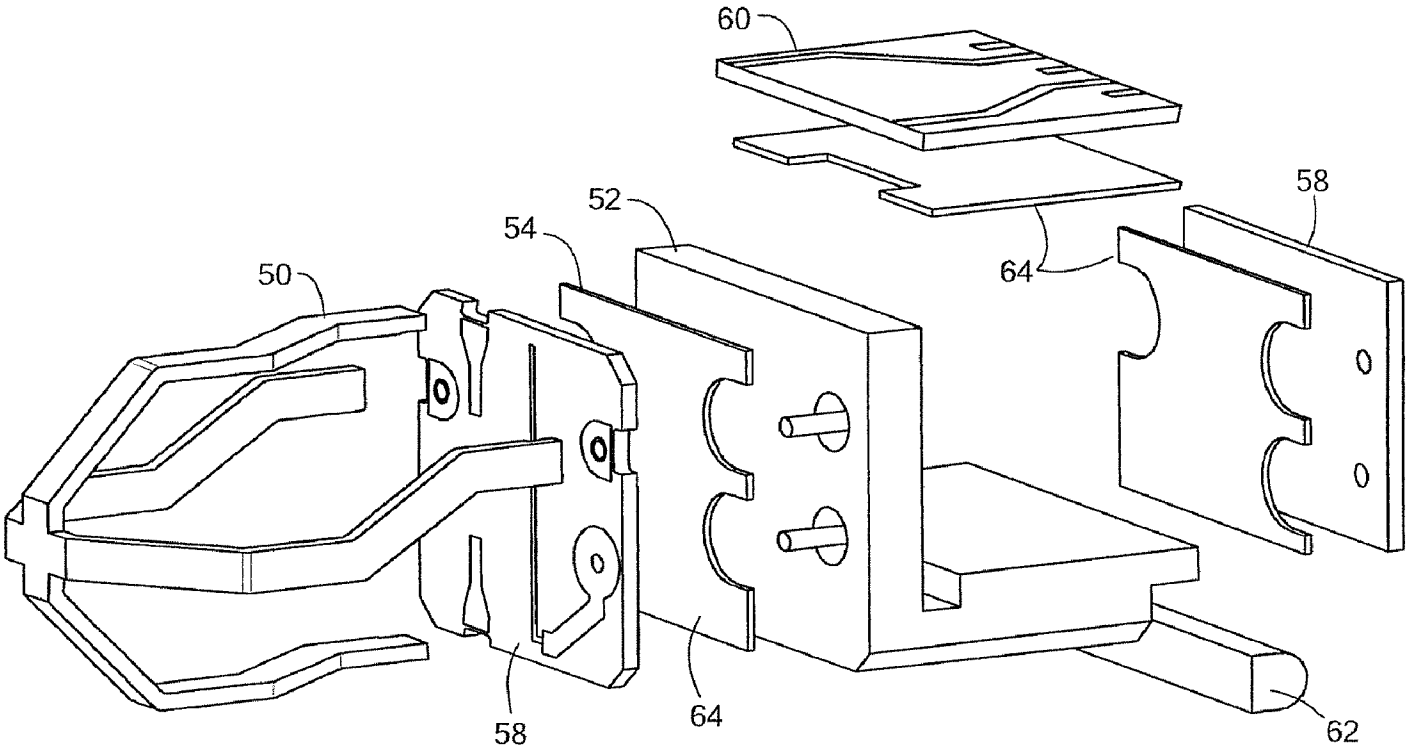
FIG. 1B is an exploded view showing components of a prior art feed and balun structure for the dual polarized coincident phase centered radiator.

The inventive slotline design reduces the part count from the prior art designs shown in FIG. 1A and FIG. 1B, to first and second multilayer printed circuit boards that can be fabricated with multiple elements in a row. Putting the 'bottom' part of the circuit (from 214 down in FIG. 2B) in a cavity may provide extra electrical isolation and structural support. The tapered fins are fed in the odd-mode and there is balanced symmetry in the launcher region of the radiator. The slotline circuits of 212, 216*a*, and 218*a* replace the prior art balun assembly for one polarization, and the slotline feed (216*b*, 218*b* to 210 and the orthogonal structure) replaces the prior art pyramidal feed circuit.

In one embodiment, the slotline circuitry is provided in about 2 mils of metal sandwiched between first and second sheets of 4 mil LCP dielectric. Exemplary dimensions are set forth below:

w1=273 mils
w2=60 mils
w3=30 mils
w4=4 mils
w5=4 mils
l1=267 mils
l2=69 mils
l3=62 mils It is understood that the illustrated embodiment is not limited to the exact geometry shown. For example, while the slotline split is shown as having semi-circular paths, other shapes providing arcuate paths are possible without departing from the scope of the present invention. Furthermore, slot widths w2, w3, w4, w5 may be varied to optimize performance versus frequency.

Figure 3:
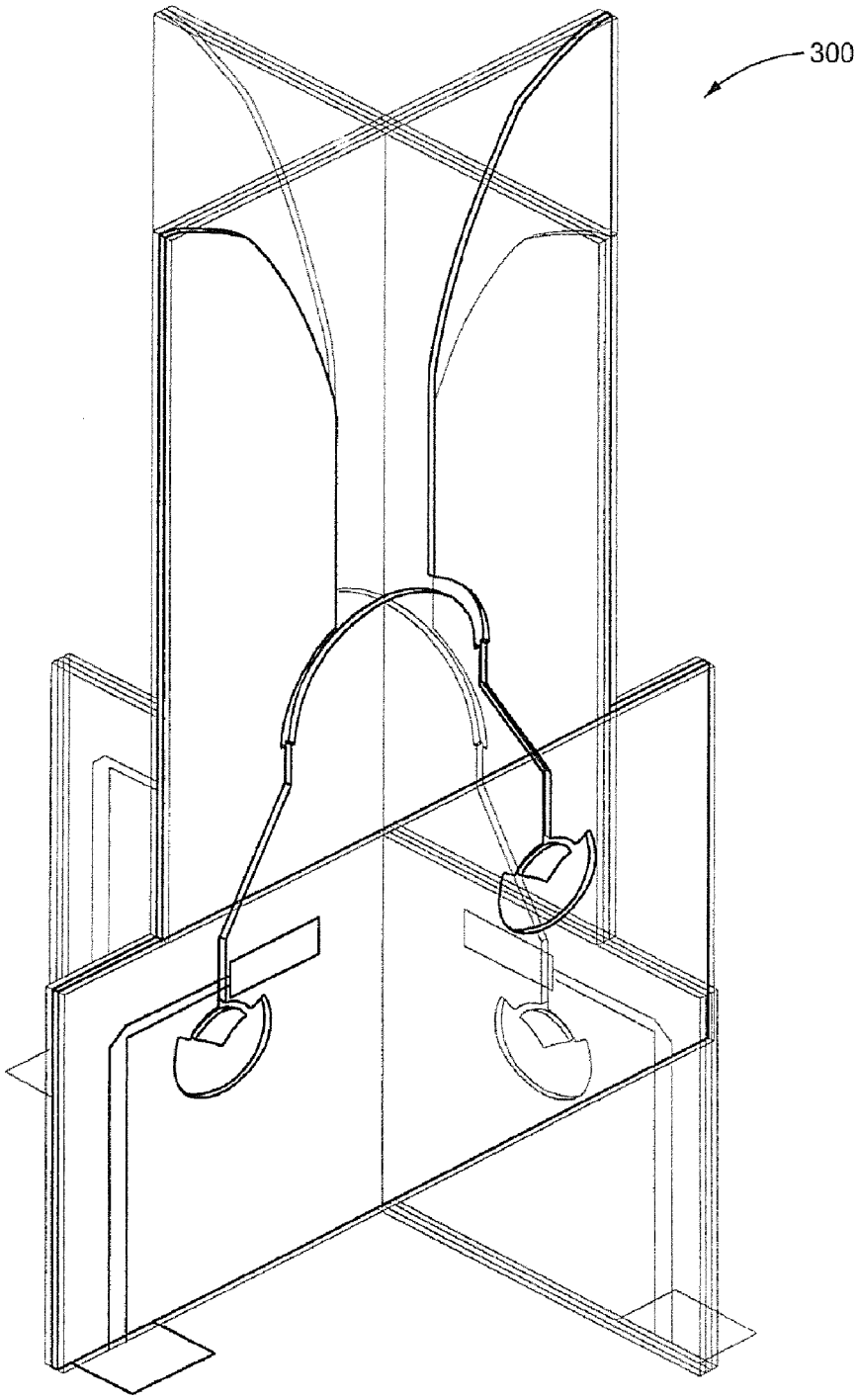
FIG. 3 is an isometric view of a four port radiator having a slotline fed by two ports per polarization.

FIG. 3 is an isometric view of a four port slotline ESCN 300. A first polarization of the dual polarized radiator is shown in solid and a second polarization is shown in wire frame providing four microstrip outputs to the unit cell that can be fed with separate balun circuits.

Figure 3A:
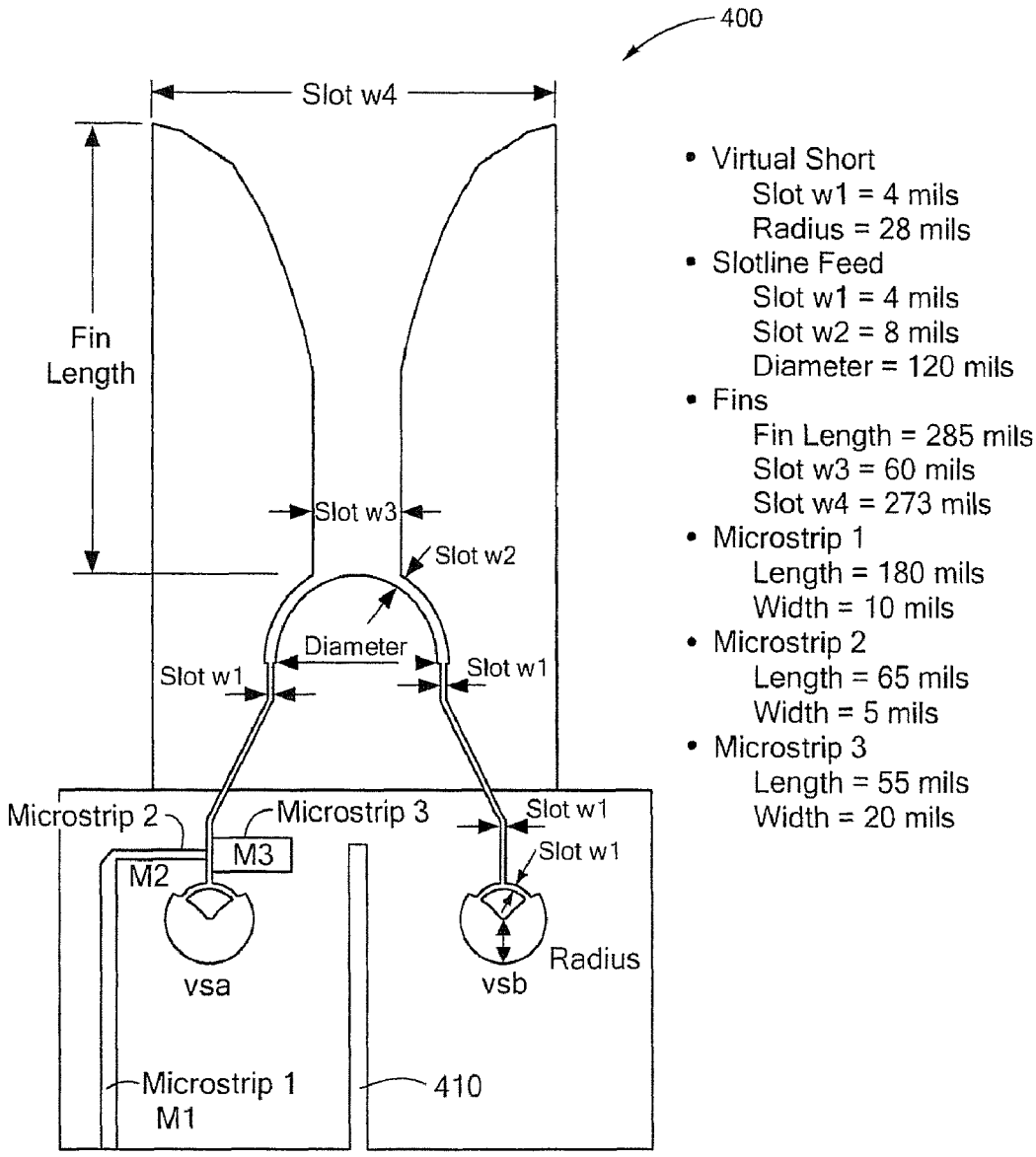
FIG. 3A is a schematic representation of a slotline radiator having a single polarization fed with two ports in accordance with exemplary embodiments of the present invention.

FIG. 3A shows exemplary dimensions for the ESCN 300 of FIG. 3. The radiator 400 includes virtual shorts VSa,b having exemplary dimensions for slot w1=4 mils and the radius=28 mils. A slotline feed includes a first slot w1=4 mils and a second slot w2=8 mils with a diameter of 120 mils to provide rejoinder in the throat of the radiator. Fins include a fin length of 285 mils, a third slot w3=60 mils and a fourth slot w4=273 mils.

First microstrip M1 has a length of 180 mils and a width of 10 mils. A second microstrip M2 has a length of 65 mils and a width of 5 mils. A third microstrip M3 has a length of 55 mils and a width of 20 mils.

In one embodiment, the radiator 400 includes a slot 410 to enable circuit boards to be placed at ninety degrees to provide coincident phase centers.

While the slotline rejoinder for the first and second slotline feeds is shown being semi-circular having a particular diameter, it is understood that other embodiments include a geometry that is generally semi-circular. As used herein, the term generally "semi-circular" means a path having a curvature from a first point to a second point where an axis through a midpoint between the first and second points and through the path defines symmetrical halves.

Figure 3B:
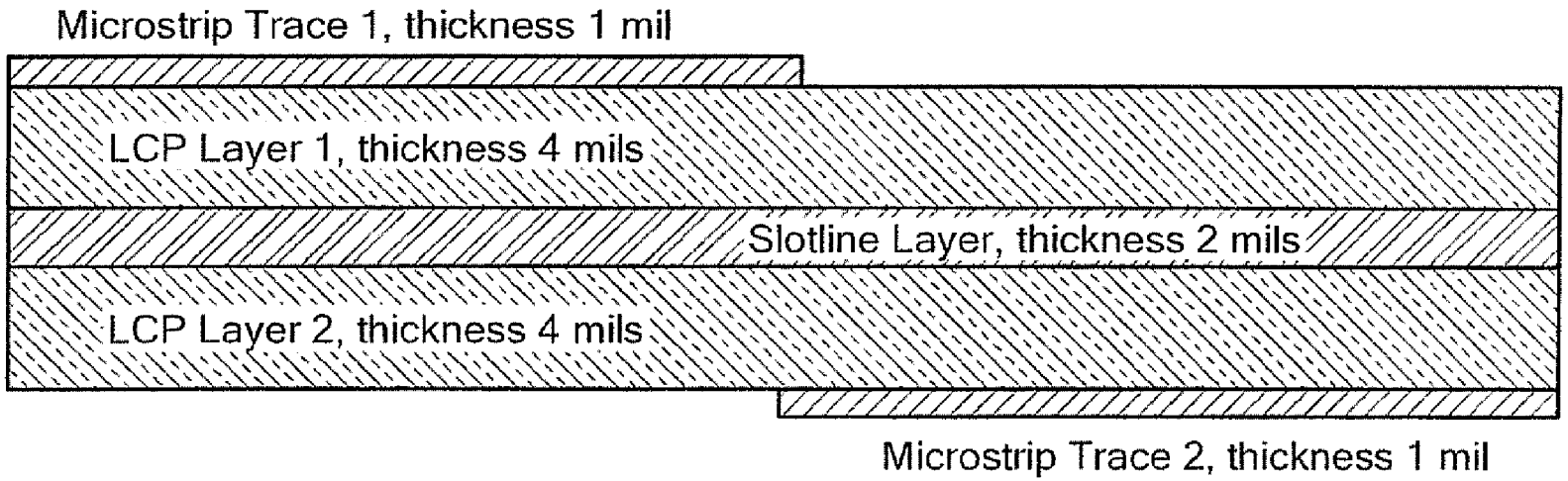
FIG. 3B is a schematic representation of a board stack-up for a single polarization of a four port radiator.

FIG. 3B shows an exemplary board stack up in accordance with exemplary embodiment of the invention. A first microstrip trace has a thickness of about 1 mil and a second microstrip trace has a thickness of about 1 mil. First and second LCP layers, each having a thickness of about 4 mils, sandwich a slotline layer having a thickness of about 2 mils.

Figure 4:
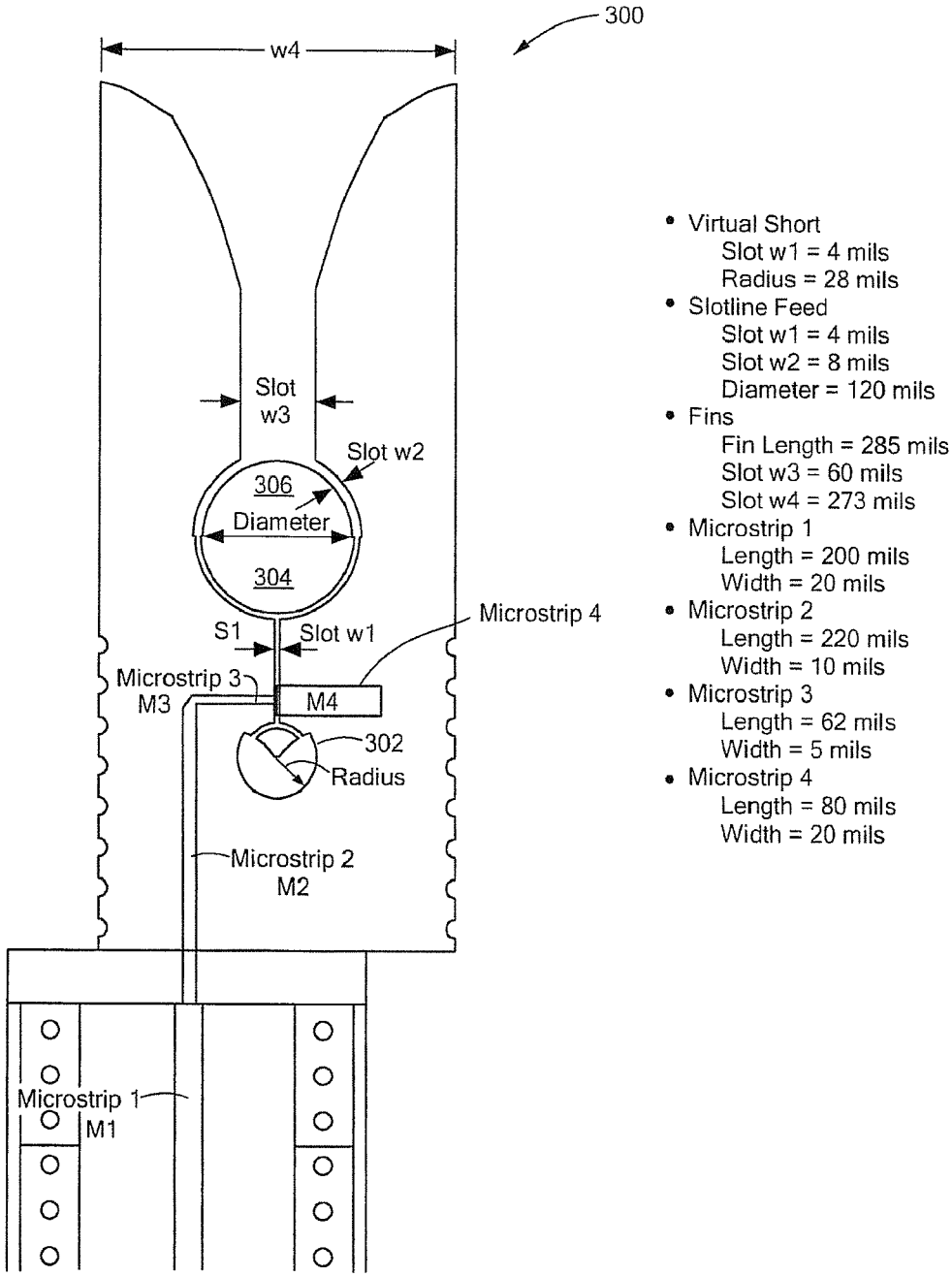
FIG. 4 is a schematic representation of a unit cell for a single polarized radiator in accordance with exemplary embodiments of the present invention.
Figure 4A:
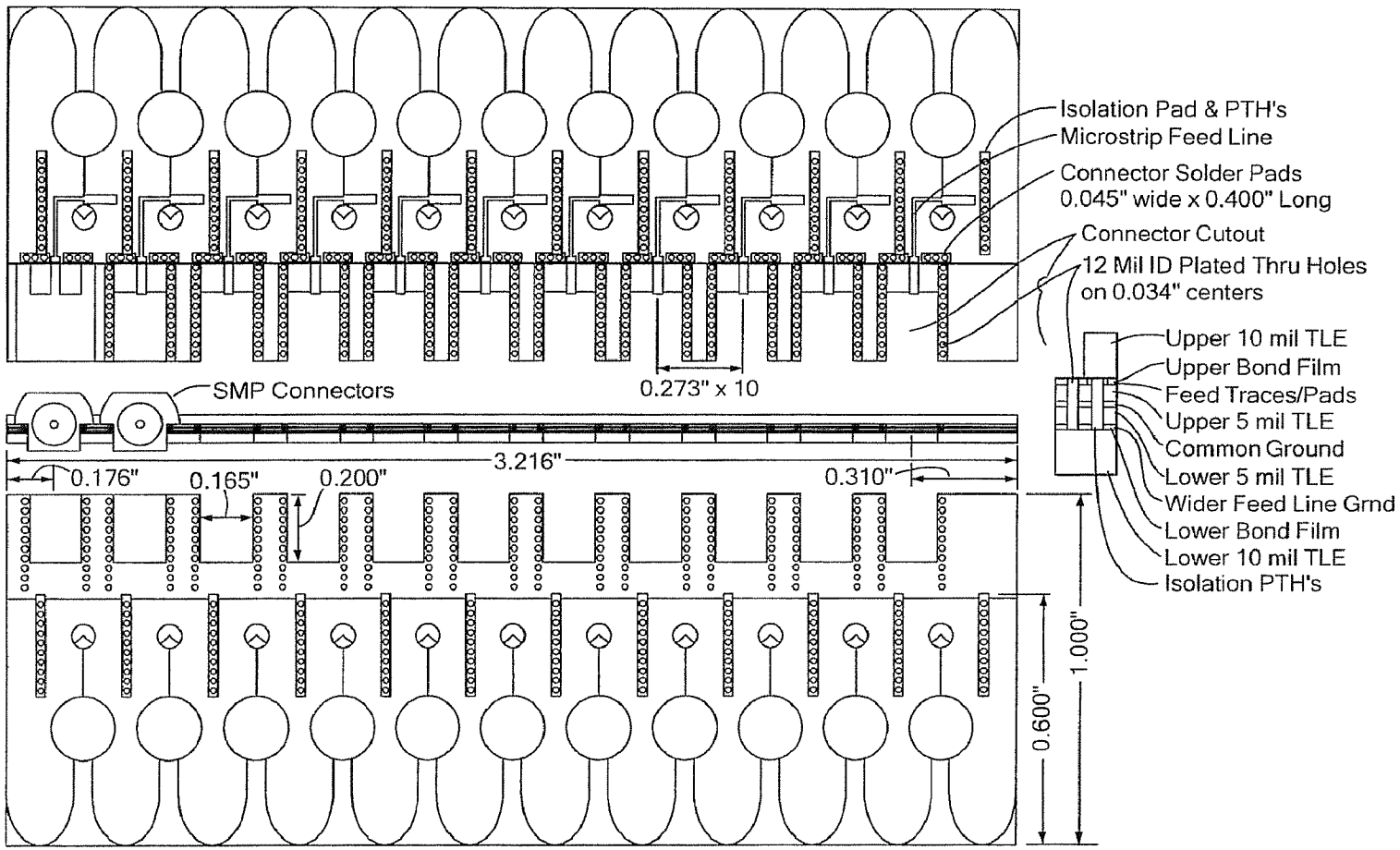
FIG. 4A is a schematic representation of a linear array.

FIG. 4 shows a side view of a unit cell of a single polarized linear array prototype, including the SMP connector interface in the model. FIG. 4A shows an eleven-element prototype illustrating an exemplary printed circuit board construction, which is also applicable to the dual polarized design of FIG. 2 without the slot cut-outs required to interleave the orthogonal boards. The single polarization for the linear array is similar to one of the boards in the dual polarized array of FIG. 2A without the bent slotline 212 that avoids the centerline of the opposite polarization.

A series of microstrips M1, M2, M3, M4, shown in FIG. 4, terminate into a slotline S1 that does not require an angle, e.g., 45 degrees, in slotline. A slotline split 304 provides equal power division and 0/180 degree phase shift.

A virtual short 302 includes a slot where w1=4 mils with a radius of 28 mils. The slotline feed includes matching slots where w1=4 mils transitioning into a wider slot in the throat region 306 where w2=8 mils with a diameter=120 mils. The first and second fins include a fin length of 285 mils, a first slot w3=60 mils, and a second slot w4=273 mils at the tip of the radiator from fin to fin.

The first microstrip M1 includes a length of 200 mils and a width of 20 mils, a second microstrip M2 includes a length of 220 mils and a width of 10 mils, a third microstrip M3 includes a length of 62 mils and a width of 5 mils, and the fourth microstrip M4 includes a length of 80 mils and a width of 20 mils.

The present invention provides exemplary embodiments of a radiator having a coincident phase centered flared notch radiator. Unit cell symmetry and odd-mode feed provide superior cross polarization isolation over a wide band and side scan. In exemplary embodiments, conventional baluns are replaced with a slotline split providing equal power division and 180 degree phase shift so as to significantly simplify manufacturing. The slotline design enables printed circuit boards to be used. Slightly different configurations for each polarization are interleaved to enable a dual polarized array.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims. All publications and references cited herein are expressly incorporated herein by reference in their entirety.

What is claimed is:

1. A radiator, comprising for each of two polarizations in a unit cell:

first and second fins to provide an air transition for a signal, the radiator including a throat region between the first and second fins;

a signal path transitioning to a slotline feed;

a slotline split forming a part of the slotline feed to provide signal power division and 180 degree phase shift for rejoinder in the throat of the radiator to launch the signal into free space.

2. The radiator according to claim 1, further including two ports,

3. The radiator according to claim 1, wherein the slotline feed includes a portion having a forty-five degree slant terminating in a phase center.

4. The radiator according to claim 1, further including a virtual short for the transition to the slotline feed.

5. The radiator according to claim 1, further including a slot for fitting together first and second circuit boards to provide a coincident phase center

6. The radiator according to claim 1, wherein the slotline feed widens in the throat of the radiator.

7. The radiator according to claim 1, wherein the signal path includes micro trip transitioning to the slotline feed.

8. The radiator according to claim 1, wherein the slotline feed includes a first portion having a first slot width and a second portion having a second slot width, the second slot width being wider than the first slot width, the second portion of the slotline feed being Moser to the throat region than the first portion.

9. A radiator, comprising for each of two polarizations in a unit cell:

first and second fins to provide an air transition for a signal;

a throat region between the first and second fins;

a first signal path transitioning to a first slotline feed;

a second signal path transitioning to a second slotline feed; and a slotline rejoinder for rejoining signals of the first and second slotline feeds in the throat of the radiator to launch signal into free space;

wherein the first and second slotline feeds each include a first portion having a first slot width and a second portion having a second slot width that is larger than the first slot width, the second portion being closer to the throat region then the first portion.

10. The radiator according to claim 9, further including virtual short coupled to each of the first and second slotline feeds near transitions to the respective first and second signal paths.

11. The radiator according to claim 9, further including a slot for fitting together first and second circuit boards to provide a coincident phase center.

12. The radiator according to claim 9, wherein the first signal path includes microstrip transitioning to the first slotline feed.

13. The radiator according to claim 9, wherein the slotline rejoinder includes a generally semi-circular region defining a portion of the first and second slotline feeds.

* * * * *